United States Patent [19]

Beckley

[11] 4,322,903

[45] Apr. 6, 1982

[54] DIRECTORY ASSEMBLY

[76] Inventor: Kenneth E. Beckley, 13460 Highway 8, Bus. Space 120, Lakeside, Calif. 92040

[21] Appl. No.: 248,818

[22] Filed: Mar. 30, 1981

[51] Int. Cl.[3] ..... G09F 11/00

[52] U.S. Cl. ..... 40/489

[58] Field of Search ..... 40/489, 371, 373, 10 R, 40/618

[56] References Cited

U.S. PATENT DOCUMENTS

| | | | |
|---|---|---|---|
| 1,501,233 | 7/1924 | Rand | 40/373 |
| 1,840,729 | 1/1932 | MacKintosh | 40/489 |
| 2,035,335 | 3/1936 | Newhard | 40/489 |
| 2,722,070 | 11/1955 | Thompson | 40/489 |
| 3,284,936 | 11/1966 | Baumunk | 40/371 |
| 3,546,799 | 12/1970 | McCoy | 40/489 |

*Primary Examiner*—Gene Mancene
*Assistant Examiner*—Wenceslao J. Contreras
*Attorney, Agent, or Firm*—Charles C. Logan, II

[57] ABSTRACT

A directory assembly suitable for use in apartment complexes, mobile home parks, medical and business centers, etc. The directory assembly is comprised of a plurality of modules attached to the front surface of a backboard member. Each of the modules has a left-side major frame member, a right-side major frame member and a plurality of tab members. The right-side and left-side major frame members are identical in shape and each has a longitudinally extending channel in its top surface. Each of the tab members have an elongated body with downwardly extending resiliently compressible structure on its opposite ends that are mateable with the longitudinally extending channels of the major frame members.

6 Claims, 1 Drawing Figure

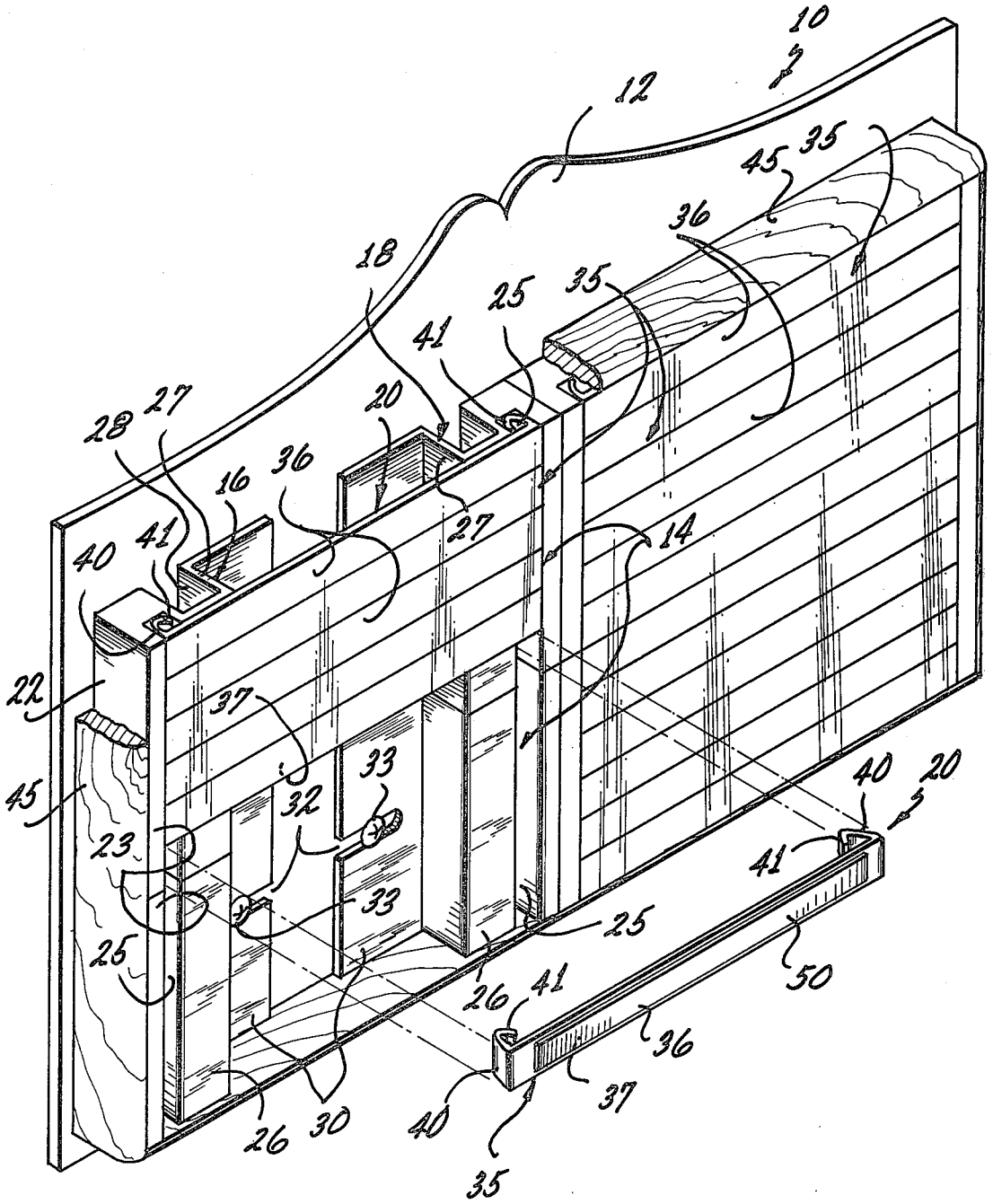
10
12
45
35
36
18
25
35
41
20
28
27
16
36
27
14
40
41
22
37
33
45
32
23
33
25
25
26
41
36
37
26
30
40
35
40
20
41
50

DIRECTORY ASSEMBLY

This patent application covers the subject matter contained in Disclosure Document No. 092760 dated July 31, 1980.

BACKGROUND OF THE INVENTION

This invention relates to directories suitable for use in hotels, motels, apartment complexes, condominiums, mobile home parks, hospitals, trailer parks, medical and business centers, etc.

Directories in current use for alphabetical listing of names of occupants, guests, or residents require a great deal of time to arrange the individual letters needed for the spelling of each name, and to place the names in proper sequence initially, and also whenever there is a change of the listing, as when residents move out and new ones move in.

SUMMARY OF THE INVENTION

One of the advantages of the novel directory assembly is that it will facilitate and speed-up the correct arranging of names on a directory in alphabetical order, and once the names are arranged, it is much easier and quicker to regroup the names whenever necessary.

Another advantage is that it is less troublesome and quicker to remove names from the novel directory assembly whenever desired.

An additional advantage of the novel directory assembly is that, unlike systems now in use, this invention does not use loose individual letters or numerals that may become lost, dislodged, or mixed up in their containers, or fall out of place from the directory.

Another advantage of the novel directory assembly is that since it does not use loose characters, it precludes the possibility of ever running short of any letter or numeral.

A further advantage of the novel directory assembly is that its modular concept makes it ideal for small establishments, and at the same time, very practical for large installations where the initial number of modules needed can be easily determined and extra modules added as required.

DESCRIPTION OF THE DRAWING

FIG. 1 is a perspective view of the novel directory assembly with portions broken away, to aid in understanding the structure of the components.

DESCRIPTION OF THE PREFERRED EMBODIMENT

Referring to FIG. 1, the novel directory assembly will be described. The directory assembly is generally designated numeral 10. It has a backboard member 12 and a plurality of modules 14 attached to its top surface.

Each of the modules 14 has a left-side major frame member 16, a right-side major frame member 18, and a plurality of tab members 20.

Left-side major frame member 16 and right-side major frame member 18 have identical structure and therefore only one of the major frame members will be described in detail. The left-side major frame member 16 has a vertically extending outside wall 22 having a longitudinal x-axis. The top surface 23 of major frame member 16 has a longitudinally extending channel 25. Laterally adjacent to channel 25 is tab member support surface 26. Extending downwardly from support surface 26 is vertically extending inside wall 27 and it along with structural elements 22 and 26 form a downwardly opening channel 28 in the bottom surface of major frame member 16. A flange 30 is formed integrally with the bottom of wall member 27 and extends laterally therefrom. A slot 32 is formed in flange 30 and a screw 33 would be inserted in slot 32 in order to fasten major frame member 16 to the top surface of backboard 12. The distance between major frame member 16 and major frame member 18 when mounted on a backboard, is determined by the length of the tab members 20. The backboard 12 may be formed of plywood, particleboard, pressed wood, or any other suitable material.

Tab members 20 have an elongated flat body 35 having a top surface 36 and a bottom surface 37. At opposite ends of body 35 are found downwardly extending end members 40 and they have a resilient finger 41 extending upwardly and inwardly in the reverse direction at an acute angle. These resilient fingers 41 are compressible to matingly interlock into the upwardly extending channels 25 formed on the major frame members, 16 and 18.

A molding or frame 45, may be placed around the outer perimeter of the modules 14.

The tab members 20 provide a structure for applying thereon a strip of pressure-sensitive tape 50 (as common embossing tape in current use) with the name of the occupant, apartment number, or whatever is required. Tab members 20 may be made of suitable flexible plastic, or other material to provide a smoothe surface to which pressure-sensitive embossed tape 50 will readily adhere, yet from which the embossed tape can be easily peeled off when desired without marring the surface of tab member 20, thus permitting its continual reuse. Tab members 20 also have the quality of always reverting back to their original shape so that they will always remain flat on the directory.

It can be easily understood how the tab members 20 are easily and quickly positioned on modules 14 by manually pressing resilient finger 41 into channels 25. Top surface 23 is slightly higher than tab member support surface 26 so that when tab members 20 are in proper position, the top surface of tab members 20 will be flush with top surface 23. Tab members 20 when in position in the directory are not loosely in place and can not move about freely, but can be manually made to move or slide within channels 25 from one location to another when necessary. The height of vertically extending inside wall 27 is just enough to allow the middle part of the tab members 20 to be depressed by a finger, pen, or pencil, so that with tab member support surfaces 26 acting as fulcrums, end members 40 of the tab member will be forced out of the channels 25 for quick and easy extraction of any tab member from module 14.

What is claimed is:

1. A directory assembly comprising:

at least one module having a left-side major frame member, a right-side major frame member, and a plurality of tab members;

said left-side major frame member having a longitudinal axis and a longitudinally extending channel in its top surface, said left-side major frame member having a tab member support surface located laterally adjacent said longitudinally extending channel;

said right-side major frame mamber having a longitudinal axis and a longitudinally extending channel in its top surface, said right-side major frame member having a tab member support surface located laterally adjacent said longitudinally extending channel; and each of said tab members having an elongated body with downwardly extending resiliently compressible means on its opposite ends that are mateable with said longitudinally extending channels on said left-side and right-side major frame members.

2. A directory assembly as recited in claim 1 further comprising a backboard member and means for attaching said left-side major frame mamber and said right-side major frame member to said backboard member.

3. A directory assembly as recited in claim 2 wherein said means for attaching said major frame members to said backboard member comprises a flange that extends laterally from the bottom of each of said major frame members, said flanges each having a laterally extending slot for receiving a screw for securing said major frame members to said backboard member.

4. A directory assembly as recited in claim 3 wherein said left-side major frame member and said right-side major frame member have identical structure.

5. A directory assembly as recited in claim 4 wherein major frame members have a longitudinally extending channel in their bottom surface located immediately below said tab member support surface.

6. A directory assembly as recited in claim 2 wherein the resiliently compressible means on the ends of said tab members comprises a downwardly extending end member with a resilient finger extending upwardly and inwardly in the reverse direction at an acute angle.

* * * * *